US012005303B2

(12) United States Patent
Xing

(10) Patent No.: US 12,005,303 B2
(45) Date of Patent: Jun. 11, 2024

(54) ADJUSTABLE ELLIPTICAL TRAINER

(71) Applicant: OMA Fitness Equipment Co., Ltd., Guangdong (CN)

(72) Inventor: Kai Bin Xing, Guangdong (CN)

(73) Assignee: OMA Fitness Equipment Co., Ltd., Guangdong (CN)

( * ) Notice: Subject to any disclaimer, the term of this patent is extended or adjusted under 35 U.S.C. 154(b) by 191 days.

(21) Appl. No.: 17/408,640

(22) Filed: Aug. 23, 2021

(65) Prior Publication Data

US 2022/0331651 A1 Oct. 20, 2022

(30) Foreign Application Priority Data

Apr. 16, 2021 (CN) ..... 202110414540.4
Apr. 16, 2021 (CN) ..... 202120784142.7

(51) Int. Cl.
*A63B 22/06* (2006.01)
*A63B 22/00* (2006.01)

(52) U.S. Cl.
CPC ..... *A63B 22/0664* (2013.01); *A63B 22/001* (2013.01); *A63B 2022/0682* (2013.01); *A63B 2225/096* (2013.01)

(58) Field of Classification Search
CPC ..... A63B 22/001; A63B 22/0015; A63B 22/0023; A63B 22/0046; A63B 22/0664; A63B 22/20; A63B 22/201; A63B 22/205; A63B 2022/0676; A63B 2022/0682; A63B 2225/09; A63B 2225/096
See application file for complete search history.

(56) References Cited

U.S. PATENT DOCUMENTS 5,759,136 A * 6/1998 Chen ..... A63B 22/0664 482/57
6,024,676 A * 2/2000 Eschenbach ..... A63B 22/001 482/52
6,422,977 B1 * 7/2002 Eschenbach ..... A63B 22/001 482/52
7,494,447 B2 * 2/2009 Eschenbach ..... A63B 21/154 482/52

(Continued)

OTHER PUBLICATIONS

European Patent Office; European Extended Search Report; European Application No. 21193383.3; dated Feb. 22, 2022; 6 pages.

*Primary Examiner* — Gary D Urbiel Goldner
(74) *Attorney, Agent, or Firm* — Faegre Drinker Biddle & Reath LLP

(57) ABSTRACT

An adjustable elliptical trainer is disclosed, which includes a body, a sliding rail, a connecting piece and a movement mechanism. The sliding rail has one end rotatably connected to the body around an axis and an other end detachably connected to the body by the connecting piece along a longitudinal extension direction of the sliding rail. The movement mechanism includes a sliding part matched with the sliding rail, and the sliding part is provided on the sliding rail and is slidable along the sliding rail. The axis is perpendicular to the longitudinal extension direction of the sliding rail, a first connection point is provided at a joint between the connecting piece and the sliding rail, and a second connection point is provided at a joint between the connecting piece and the body, the connecting piece is configured to be movable relative to the sliding rail and/or the body.

6 Claims, 4 Drawing Sheets

(56) References Cited

U.S. PATENT DOCUMENTS

| | | | | |
|---|---|---|---|---|
| 2003/0013581 | A1* | 1/2003 | Kaganovsky | A63B 22/0664 482/51 |
| 2013/0012363 | A1* | 1/2013 | Eschenbach | A63B 22/0664 482/52 |
| 2013/0237379 | A1 | 9/2013 | Huang et al. | |
| 2014/0194253 | A1* | 7/2014 | Huang | A63B 22/0664 482/52 |
| 2014/0194254 | A1* | 7/2014 | Huang | A63B 22/001 482/52 |
| 2015/0335942 | A1 | 11/2015 | Murray | |
| 2017/0157460 | A1 | 6/2017 | Lin | |

* cited by examiner

ADJUSTABLE ELLIPTICAL TRAINER

CROSS-REFERENCE TO RELATED APPLICATION

This application claims priorities to Chinese Patent Application No. 202110414540.4 and No. 202120784142.7, filed on Apr. 16, 2021, both of which are hereby incorporated by reference in their entireties.

TECHNICAL FIELD

The present disclosure relates to the technical field of sports fitness equipment, and in particular, to an adjustable elliptical trainer.

BACKGROUND

At present, with the construction of cities and the acceleration of the pace of human life, people have fewer and fewer opportunities to go to sports venues for exercise. Therefore, more and more people choose to use gyms or home fitness equipment for exercise. Among them, an elliptical trainer that can simulate the trajectory of people's legs when stepping is loved by many people.

SUMMARY

Based on the above, it is necessary to provide an adjustable elliptical trainer to solve the problems that the trajectory of the elliptical trainer is simple and cannot be adjusted.

Embodiments of the present disclosure provide an adjustable elliptical trainer including: a body; a sliding rail and a connecting piece, wherein, the sliding rail has one end rotatably connected to the body around an axis and an other end detachably connected to the body by the connecting piece along a longitudinal extension direction of the sliding rail; and a movement mechanism including a sliding part matched with the sliding rail, the sliding part being provided on the sliding rail and being slidable along the sliding rail; wherein the axis is perpendicular to the longitudinal extension direction of the sliding rail, a first connection point is provided at a joint between the connecting piece and the sliding rail, and a second connection point is provided at a joint between the connecting piece and the body, the connecting piece is configured to be movable relative to the sliding rail and/or the body to adjust a distance between the first connection point and the second connection point, so as to adjust an angle at which the sliding rail is inclined to the body.

In an embodiment, the connecting piece is a fixing plate, one end of the fixing plate is fixedly connected to the sliding rail, and a plurality of fixing holes are provided in the fixing plate, and distances between each of the fixing holes and the first connection point are different, an other end of the fixing plate is detachably connected to the body by respective fixing holes.

In an embodiment, the sliding rail and the fixing plate are integrally formed.

In an embodiment, the connecting piece is a telescopic rod, the telescopic rod has a fixed end and a movable end, and the movable end is configured to be able to adjust a length that extends out of the fixed end, the fixed end is connected to the body, and the movable end is connected to the sliding rail.

In an embodiment, it further includes: a motor configured to be able to drive the movable end to be extended and retracted relative to the fixed end.

In an embodiment, the body includes a fixing frame and an upright column inclined to the fixing frame, and the one end of the sliding rail is rotatably connected to one of the fixing frame and the upright column, and the other end of the sliding rail is connected to the other of the fixing frame and the upright column by the connecting piece.

In an embodiment, the movement mechanism includes a handle lever, a swing lever, and a crank, both ends of the crank are respectively rotatably connected to the fixing frame and the swing lever, and the handle lever is fixedly connected to the swing lever.

In an embodiment, the movement mechanism further includes a first link, and both ends of the first link are respectively rotatably connected to the upright column and the swing lever.

In an embodiment, the movement mechanism further includes a track plate and a slider, the track plate is fixedly connected to the upright column, a guide groove is formed on the track plate, one end of the slider is connected to the swing lever, and the an other end of the slider is received in the guide groove and is slidable along the guide groove.

In an embodiment, the movement mechanism further includes a second link, a stand pipe, and a pedal; one end of the second link is rotatably connected to the swing lever, and an other end of the second link is fixedly connected to the pedal; and, one end of the stand pipe is connected to the second link, and the sliding part is provided at an other end of the stand pipe.

DETAILED DESCRIPTION

In order to make the above objects, features, and advantages of the present disclosure more obvious and understandable, specific embodiments of the present disclosure will be described in detail below with reference to the accompanying drawings. In the following description, many specific details are set forth in order to fully understand the present disclosure. However, the present disclosure can be implemented in many other ways different from those described here, and those skilled in the art can make similar improvements without violating the connotation of the present disclosure. Therefore, the present disclosure is not limited by the specific embodiments disclosed below.

It should be noted that when an element is referred to as being "fixed to" another element, it can be directly on the other element or an intermediate element may also be present. When an element is considered to be "connected" to another element, it can be directly connected to the other element or an intermediate element may be present at the same time.

Unless otherwise defined, the technical and scientific terms used herein have the same meaning as commonly understood by those skilled in the art of the present disclosure. The terms used in the specification of the present disclosure herein are only for the purpose of describing specific embodiments, and are not intended to limit the present disclosure. The term "and/or" as used herein includes any and all combinations of one or more related listed items.

Figure 1:
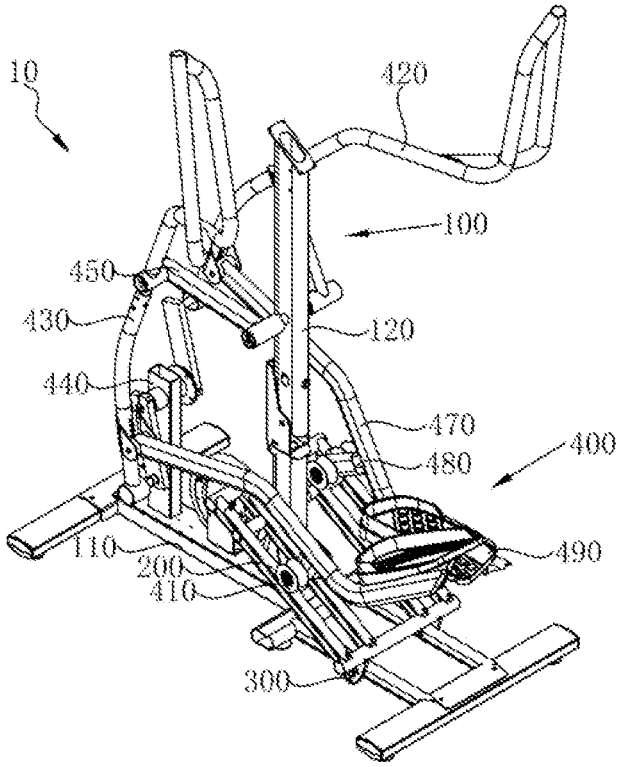
FIG. 1 is a schematic diagram of an overall structure of an adjustable elliptical trainer provided by an embodiment of the present disclosure.
Figure 2:
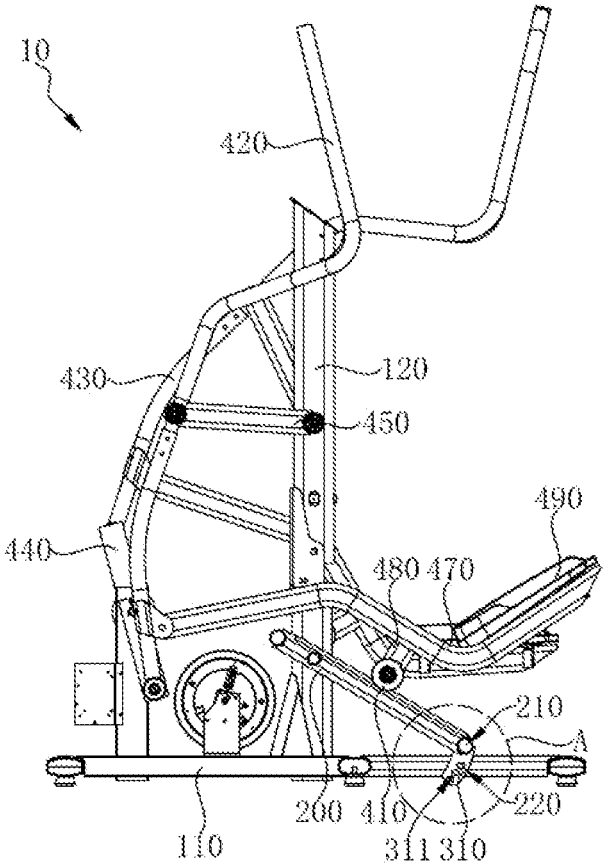
FIG. 2 is a schematic structural view of an adjustable elliptical trainer provided by an embodiment of the present disclosure from one perspective.

FIG. 1 is a schematic diagram of an overall structure of an adjustable elliptical trainer provided by an embodiment of the present disclosure, and FIG. 2 is a schematic structural view of the adjustable elliptical trainer provided by an embodiment of the present disclosure from one perspective.

Please refer to FIGS. 1 and 2, an embodiment of the present disclosure provides an adjustable elliptical trainer 10. The adjustable elliptical trainer 10 includes a body 100, a sliding rail 200, a connecting piece 300, and a movement mechanism 400. The body 100 is fixed, and both ends of the sliding rail 200 are respectively fixed at different positions of the body 100. Along the length direction of the sliding rail 200, one end of the sliding rail 200 is rotatably connected to the body 100, and the other end of the sliding rail 200 is detachably connected to the body 100 by the connecting piece 300. By adjusting the connecting piece 300, an angle at which the sliding rail 200 is inclined to the body 100 can be changed. At the same time, the movement mechanism 400 includes a sliding part 410 that matches the sliding rail 200. The sliding part 410 is provided on the sliding rail 200 and is slidable along the sliding rail 200. In this way, the movement mechanism 400 will slide on the slide rail 200 along with the slide portion 410 when the user uses it. When the angle at which the slide rail 200 is inclined to the body 100 changes, the motion trajectory of the motion mechanism 400 is also change, and the effect reflected to the user is that the exercise intensity has changed. As a result, it is possible to meet the exercise requirements of users with different exercise intensities by adjusting the angle at which the sliding rail 200 is inclined to the body 100.

The body 100 is a fixed component in the adjustable elliptical trainer 10, and is used to install, locate, and connect other components or assemblies in the adjustable elliptical trainer 10, such as the sliding rail 200, the movement mechanism 400, and the like. Structure, shape and size of the body 100 are not limited, and can be flexibly adjusted according to the design requirements of the adjustable elliptical trainer 10.

Along the longitudinal extension direction of the sliding rail 200, one end of the sliding rail 200 is rotatably connected to the body 100 around an axis being perpendicular to the longitudinal extension direction of the sliding rail 200, and the other end of the sliding rail 200 is connected to the body 100 by the connecting piece 300. The sliding rail 200 is a component of the adjustable elliptical trainer 10 that matches with the movement mechanism 400. When the user uses the adjustable elliptical trainer 10, the user drives the movement mechanism 400 to move on the sliding rail 200 to achieve the effect of exercise. It is understandable that by adjusting the angle at which the sliding rail 200 is inclined to the body 100, the movement trajectory of the movement mechanism 400 is also changed, and the effect reflected to the user is that the exercise intensity has changed. Therefore, in the embodiments of the present disclosure, through this principle, the adjustable elliptical trainer 10 can meet the requirements of users with different exercise intensities.

In order to adjust the angle at which the sliding rail 200 is inclined to the body 100, a first connection point 210 is provided at a joint between the connecting piece 300 and the sliding rail 200, and a second connection point 220 is provided at a joint between the connecting piece 300 and the body 100. The connecting piece 300 is configured to be movable relative to the sliding rail 200 and/or the body 100 to adjust the distance between the first connection point 210 and the second connection point 220, thereby adjusting the angle at which the sliding rail 200 is inclined to the body 100. There are many ways to adjust the distance between the first connection point 210 and the second connection point 220. For example, the connecting piece 300 can be provided with multiple connection structures at different positions, and the position of the connecting piece 300 can be adjusted so that it is connected to the sliding rail 200 and the body 100 by the connection structures at different positions, and thus the distance between the first connection point 210 and the second connection point 220 will change. It is also possible that the connecting piece 300 includes two different units. One unit is connected to the sliding rail 200, and the other unit is connected to the body 100, and the two units are movable relative to each other. In this way, after the two units are moved relative to each other, the distance between the first connection point 210 and the second connection point 220 will change. It should be noted that when the adjustable elliptical trainer 10 is in use, that is, when the movement mechanism 400 is in a motion state, the connecting piece 300 is fixedly connected to the sliding rail 200 and the body 100. At this time, the distance between the first connection point 210 and the second connection point 220 is also kept relatively fixed to maintain the stability of the sliding rail 200, to ensure that the movement mechanism 400 can move normally, and to ensure the safety of the user. When the adjustable elliptical trainer 10 is in a disabled state, that is, when the movement mechanism 400 is in a non-motion state, the connecting piece 300 can be adjusted to change the distance between the first connection point 210 and the second connection point 220.

With the adjustable elliptical trainer 10 provided by the embodiments of the present disclosure, one end of the sliding rail 200 is rotatably connected to the body 100 and the other end of the sliding rail 200 is detachably connected to the body 100 by the connecting piece 300, the first connection point 210 is provided at a joint between the connecting piece 300 and the sliding rail 200 and the second connection point 220 is provided at a joint between the connecting piece 300 and the body 100, and the connecting piece 300 is able to adjust a distance between the first connection point 210 and the second connection point 220. After adjustment, the end of the slide rail 200 connected to the connecting piece 300 will rotate relative to the end of the slide rail 200 connected to the body 100. In this way, the angle at which the slide rail 200 is inclined to the body 100 also changes. When the user is exercising by using the motion mechanism 400, since the sliding part 410 of the motion mechanism 400 is provided on the slide rail 200, and the motion trajectory of the motion mechanism 400 also changes, and the effect reflected to the user is that the exercise intensity changes. The adjustable elliptical trainer 10 in the present disclosure has a simple structure, and the angle at which the slide rail 200 is inclined to the body 100 is easily adjusted, which can well meet the requirements of users with different exercise intensities.

Figure 3:
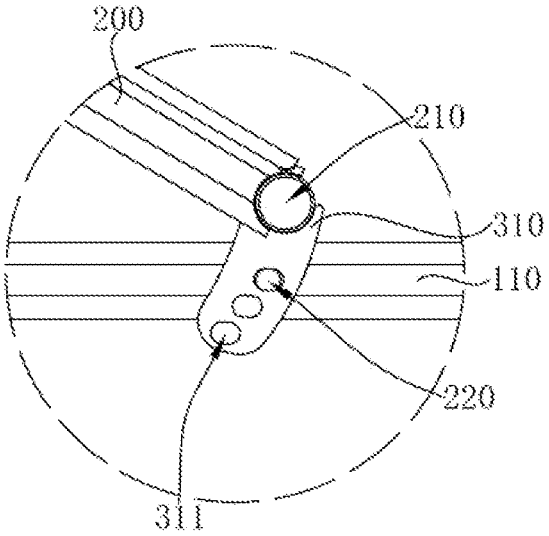
FIG. 3 is a partial enlarged schematic diagram at A in FIG. 2.

FIG. 2 is a schematic structural view of an adjustable elliptical trainer 10 provided by an embodiment of the present disclosure from one perspective, and FIG. 3 is a partial enlarged schematic diagram at A in FIG. 2.

Please refer to FIG. 2 and FIG. 3 in conjunction with FIG. 1, as described above, multiple connecting structures can be provided at different positions on the connecting piece 300, and the position of the connecting piece 300 can be adjusted so that it is respectively connected to the sliding rail 200 and the body 100 by the connecting structures at different positions, and thus the distance between the first connection point 210 and the second connection point 220 will change. Specifically, in some embodiments, the connecting piece 300 is a fixing plate 310, one end of the fixing plate 310 is fixedly connected to the sliding rail 200, and a plurality of fixing holes 311 are provided in the fixing plate 310, distances between each of the fixing holes 311 and the first connection point 210 are different, and the other end of the fixing plate 310 is detachably connected to the body 100 by respective fixing holes 311. The connection between the fixing plate 310 and the body 100 can be realized with the help of the connecting piece 300 such as a screw. For example, threaded holes are provided on the body 100 at the positions respectively corresponding to the fixing holes 311, and screws pass through the respective fixing holes 311 and then are screwed into the threaded holes to achieve fixation. It is also possible to provide bumps matching the fixing holes 311 respectively at positions of the body 100 corresponding to the fixing holes 311, and the bumps gets into the fixing holes 311 to be engaged with the fixing plate 310 to achieve fixation. The number of fixing holes 311 can be flexibly set according to the number of gears that need to be adjusted, and it is not specifically limited here. The more the number of fixing holes 311, the smaller the angle change of the sliding rail 200 between two adjacent gears, and the finer the adjustment range. The smaller the number of fixing holes 311, the greater the angle change of the sliding rail 200 between two adjacent gears, and the greater the adjustment range. Similarly, in other embodiments, one end of the fixing plate 310 can be fixedly connected to the body 100, and the other end of the fixing plate 310 can be detachably connected to the sliding rail 200 by the respective fixing holes 311. At this time, the adjustment principle is the same and will not be repeated here.

When one end of the fixing plate 310 is fixedly connected to the sliding rail 200, the fixing plate 310 and the sliding rail 200 can be connected by common connection manner used in the art including welding, riveting, and bonding. In some embodiments, the sliding rail 200 and the fixing plate 310 may also be integrally formed. The integrally formed connection method is adopted to make the connection between the sliding rail 200 and the fixing member tighter, and the processing of the sliding rail 200 and the fixing member simpler and more convenient. Similarly, when one end of the fixing plate 310 is fixedly connected to the body 100, the fixing plate 310 and the body 100 can also be integrally formed.

Figure 5:
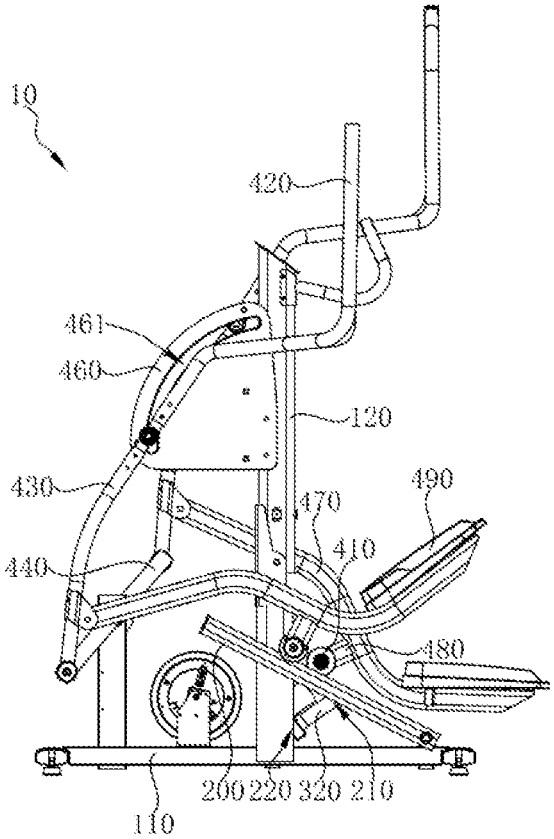
FIG. 5 is a schematic structural diagram of an adjustable elliptical trainer provided by an embodiment of the present disclosure from another perspective.
Figure 6:
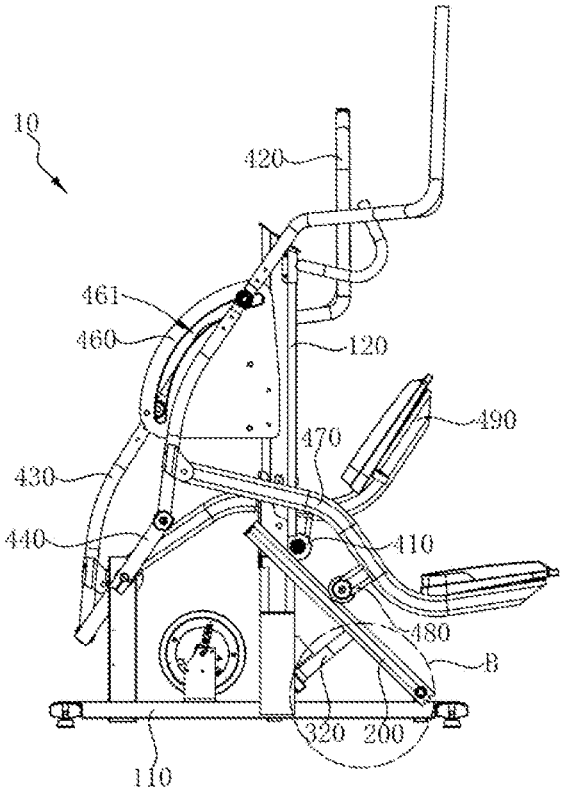
FIG. 6 is a schematic structural diagram of an adjustable elliptical trainer provided by an embodiment of the present disclosure from yet another perspective.

FIG. 5 is a schematic structural diagram of an adjustable elliptical trainer provided by an embodiment of the present disclosure from another perspective, in which an angle between the sliding rail 200 and the body 100 is 30°; FIG. 6 is a schematic structural diagram of an adjustable elliptical trainer provided by an embodiment of the present disclosure from yet another perspective, in which an angle between the sliding rail 200 and the body 100 is 43°; and FIG. 7 is a partial enlarged schematic diagram at B in FIG. 6.

Figure 4:
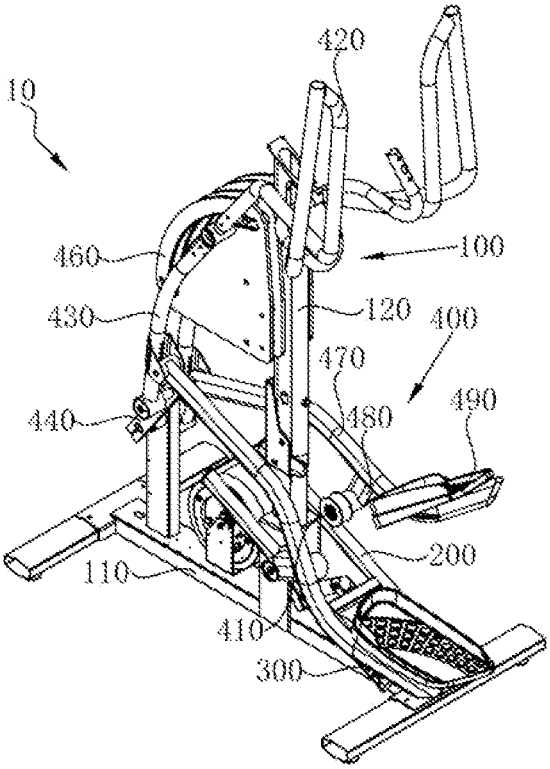
FIG. 4 is a schematic diagram of an overall structure of an adjustable elliptical trainer provided by an embodiment of the present disclosure.
Figure 7:
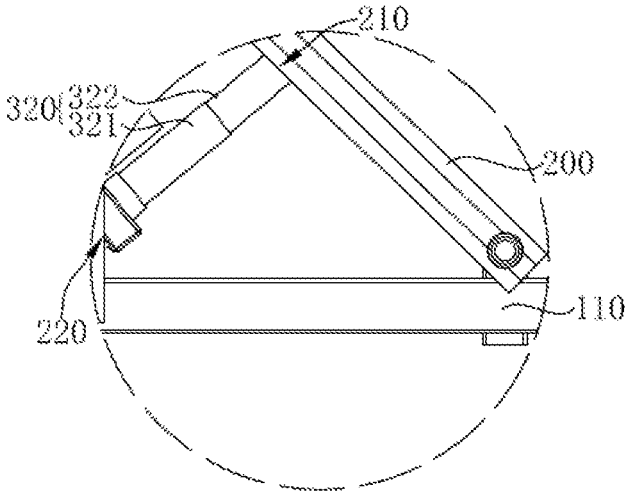
FIG. 7 is a partial enlarged schematic diagram at B in FIG. 6.

Please refer to FIGS. 5 to 7 in conjunction with FIG. 4, as described above, the connecting piece 300 may also include two different units, one unit is connected to the sliding rail 200, and the other unit is connected to the body 100, and the two units are movable relative to each other. In this way, after the two units are moved relative to each other, the distance between the first connection point 210 and the second connection point 220 will change. Specifically, in some embodiments, the connecting piece 300 is a telescopic rod 320, the telescopic rod 320 has a fixed end 321 and a movable end 322, the movable end 322 is configured to be able to adjust the length that extends out of the fixed end 321, and the fixed end 321 is connected to the body 100, and the movable end 322 is connected to the sliding rail 200. The telescopic rod 320 can adopt a structure such as a push rod and an oil cylinder. When the telescopic rod 320 is extended, the distance between the first connection point 210 and the second connection point 220 will increase, and the angle at which the sliding rail 200 is inclined to the body 100 will also increase. When the telescopic rod 320 is retracted, the distance between the first connection point 210 and the second connection point 220 will decrease, and the angle at which the sliding rail 200 is inclined to the body 100 will decrease accordingly. Different from the embodiment where the connecting piece 300 is the fixing plate 310, in this embodiment, the length of the telescopic rod 320 can be continuously adjusted in multiple gears, and the angle at which the sliding rail 200 is inclined to the body 100 can be continuously adjusted within a certain range. For example, in this embodiment, the angle at which the sliding rail 200 is inclined to the body 100 can be continuously adjusted between 30° and 43°. In other embodiments, the angle at which the sliding rail 200 is inclined to the body 100 can be adjusted further within a larger or smaller range. Therefore, the scope of application scenarios of the adjustable elliptical trainer 10 in this embodiment is wider. Similarly, in other embodiments, the fixed end 321 may be connected to the sliding rail 200, and the movable end 322 may be connected to the body 100. At this time, the adjustment principle is the same and will not be repeated here.

On the basis of the above-mentioned embodiments, further, in order to improve the degree of automation of the adjustable elliptical trainer 10 and make it easier to adjust and use, the adjustable elliptical trainer 10 also includes a motor, which is configured to drive the movable end 322 to be extended and retracted relative to fixed end 321. At this time, there is no need to manually adjust the length of the movable end 322 extending out of the fixed end 321, just control the motor to start or stop, and the telescopic rod 320 can be driven by the power of the motor to adjust the length, and then adjust the angle at which the sliding rail 200 is inclined to the body 100. The adjustment is simpler and more convenient. Moreover, by adjusting the degree of power output of the motor, speed of the movable end 322 of the telescopic rod 320 can also be changed. If the power output of the motor is large, the movable end will extend and retract faster, and the angle at which the sliding rail 200 is inclined to the body 100 will be faster. If the power output of the motor is small, the movable end will extend and retract slowly, and the angle at which the sliding rail 200 is inclined to the body 100 will be slower. The control and adjustment are more precise.

In order to make the structure of the body 100 more stable, it also provides a better connection and support for other components in the adjustable elliptical trainer 10. In some embodiments, the body 100 includes a fixing frame 110 and an upright column 120 inclined to the fixing frame 110, one end of the sliding rail 200 is rotatably connected to one of the fixing frame 110 and the upright column 120, and the other end of the sliding rail 200 is connected to the other of the connecting piece 300 and the fixing frame 110 and the upright column 120 by the connecting piece 300. The sliding rail 200 adopts the sliding rail 200, which allows the movement mechanism 400 to slide along the sliding rail 200. As shown in FIGS. 1 to 3, in some embodiments, one end of the sliding rail 200 is rotatably connected to the upright column 120, and the other end of the sliding rail 200 is connected to the fixing frame 110 by the connecting piece 300. As shown in FIGS. 4 to 7, in some other embodiments, one end of the sliding rail 200 is rotatably connected to the fixing frame 110, and the other end of the sliding rail 200 is connected to the upright column 120 by the connecting piece 300. The above two structural forms can be flexibly set according to actual use requirements.

In the adjustable elliptical trainer 10, in order to allow the user to exercise normally, in some embodiments, the movement mechanism 400 includes a handle lever 420, a swing lever 430, and a crank 440. Both ends of the crank 440 are respectively rotatably connected to the fixing frame 110 and the swing lever 430, and the handle lever 420 is fixedly connected to the swing lever 430. Further, the movement mechanism 400 further includes a first link 450, and both ends of the first link 450 are respectively rotatably connected to the upright column 120 and the swing lever 430. On the one hand, the handle lever 420 is rotatably connected to the crank 440 by the swing lever 430, and the crank 440 is rotatably connected to the fixing frame 110, on the other hand, the swing lever 430 is rotatably connected to the upright column 120 by the first link 450. That is, the handle lever can drive the crank 440 and the fixing frame 110 to move relative to each other, and at the same time drive the first link 450 and the upright column 120 to move relative to each other. At this time, the user can reciprocate the handle lever back and forth to realize the exercise of the arm.

In some other embodiments, the movement mechanism 400 further includes a track plate 460 and a slider. The track plate 460 is fixedly connected to the upright column 120, the track plate 460 is provided with a guide groove 461, and one end of the slider is connected to the swing lever 430, and the other end of the slider is received in the guide groove 461 and can slide along the guide groove 461. At this time, on the one hand, the handle lever 420 is rotatably connected to the crank 440 by the swing lever 430, and the crank 440 is rotatably connected to the fixing frame 110. On the other hand, the swing lever 430 is connected to the track plate 460 by the slider. That is, the handle lever can drive the crank 440 and the fixing frame 110 to move relative to each other, and at the same time drive slider to slide in the guide groove 461 of the track plate 460. At this time, the user can reciprocate the handle lever back and forth to realize the exercise of the arm.

At the same time, in some embodiments, the movement mechanism 400 further includes a second link 470, a stand pipe 480, and a pedal 490. One end of the second link 470 is rotatably connected to the swing lever 430, and the other end of the second link 470 is fixedly connected to the pedal 490, one end of the stand pipe 480 is connected to the second link 470, and the sliding part 410 is located at the other end of the stand pipe 480. The pedal 490 can drive the second link 470 and the swing lever 430 to move relative to each other, and at the same time drive the sliding part 410 to slide on the sliding rail 200. At this time, the user can step on the pedal 490 to perform back and forth reciprocating motions to exercise the legs. It should be noted that in order to facilitate the normal use of users, the number of structures such as the sliding rail 200, connecting piece 300 in the adjustable elliptical trainer 10, and the sliding part 410, handle lever 420, swing lever 430, crank 440, first link 450, track plate 460, second link 470, stand pipe 480, pedal 490 in the movement mechanism 400, etc. are two groups, and the two groups of the above-mentioned components are respectively arranged on both sides of the upright column 120, so that the user can exercise both hands and legs. In addition, the two groups of components are opposed to each other, that is, the movement between the two groups of components can be asynchronous, so that the user's hands and legs can perform asynchronous staggered movements during use.

In summary, due to the numerous motion mechanisms in the adjustable elliptical trainer 10, the user can exercise both arms and legs at the same time when using the adjustable elliptical trainer 10, and the effect is good. One end of the sliding rail 200 is rotatably connected to the body 100 around an axis, the other end of the sliding rail 200 is detachably connected to the body 100 by the connecting piece 300, the first connection point 210 is provided at a joint between the connecting piece 300 and the sliding rail 200 and the second connection point 220 is provided at a joint between the connecting piece 300 and the body 100, and the connecting piece 300 is movable relative to the sliding rail 200 and/or the body 100 so as to adjust a distance between the first connection point 210 and the second connection point 220. After adjustment, the end of the slide rail 200 connected to the connecting piece 300 will rotate relative to the end of the slide rail 200 connected to the body 100. In this way, the angle at which the slide rail 200 is inclined to the body 100 also changes. When the user is exercising by using the motion mechanism 400, since the sliding part 410 of the motion mechanism 400 is provided on the slide rail 200, and the motion trajectory of the motion mechanism 400 also changes, and the effect reflected to the user is that the exercise intensity changes, which can well meet the requirements of users with different exercise intensities. When it is not in use, the relative positions between the various mechanisms can be flexibly adjusted, which facilitates the folding and storage by users, saves the space occupied by the adjustable elliptical trainer 10, maximizes space utilization, and facilitates storage and transportation.

These technical features of the above-mentioned embodiments can be combined arbitrarily. In order to make the description concise, all possible combinations of the various technical features in the above-mentioned embodiments are not described. However, as long as there is no contradiction in the combination of these technical features, it should be regarded as the scope of this specification.

The above-mentioned embodiments only express several implementations of the present disclosure, and their descriptions are more specific and detailed, but they should not be interpreted as limiting the scope of the patent. It should be pointed out that for those skilled in the art, several modifications and improvements can be made without departing from the concept of this patent, and these all fall within the protection scope of the present disclosure. Therefore, the protection scope of the present disclosure shall be subject to the appended claims.

What is claimed is:

1. An adjustable elliptical trainer, comprising:

a body;

a sliding rail and a connecting piece, wherein, the sliding rail has one end rotatably connected to the body around an axis and an other end detachably connected to the body by the connecting piece along a longitudinal extension direction of the sliding rail; and a movement mechanism comprising a sliding part matched with the sliding rail, the sliding part being provided on the sliding rail and being slidable along the sliding rail;

wherein the axis is perpendicular to the longitudinal extension direction of the sliding rail, a first connection point is provided at a joint between the connecting piece and the sliding rail, and a second connection point is provided at a joint between the connecting piece and the body, the connecting piece is configured to be movable relative to the sliding rail and/or the body to adjust a distance between the first connection point and the second connection point, so as to adjust an angle at which the sliding rail is inclined to the body;

wherein the connecting piece is a fixing plate, one end of the fixing plate is fixedly connected to the sliding rail, and a plurality of fixing holes are provided in the fixing plate, and distances between each of the plurality of fixing holes and the first connection point are different, an other end of the fixing plate is detachably connected to the body by respective fixing holes.

2. The adjustable elliptical trainer of claim 1, wherein the sliding rail and the fixing plate are integrally formed.

3. The adjustable elliptical trainer of claim 1, wherein the body comprises a fixing frame and an upright column inclined to the fixing frame, and the one end of the sliding rail is rotatably connected to one of the fixing frame and the upright column, and the other end of the sliding rail is connected to the other of the fixing frame and the upright column by the connecting piece.

4. The adjustable elliptical trainer of claim 3, wherein the movement mechanism comprises a handle lever, a swing lever, and a crank, both ends of the crank are respectively rotatably connected to the fixing frame and the swing lever, and the handle lever is fixedly connected to the swing lever.

5. The adjustable elliptical trainer of claim 4, wherein the movement mechanism further comprises a first link, and both ends of the first link are respectively rotatably connected to the upright column and the swing lever.

6. The adjustable elliptical trainer of claim 5, wherein the movement mechanism further comprises a second link, a stand pipe, and a pedal; one end of the second link is rotatably connected to the swing lever, and an other end of the second link is fixedly connected to the pedal; and, one end of the stand pipe is connected to the second link, and the sliding part is provided at an other end of the stand pipe.

* * * * *